United States Patent [19]

Nogami et al.

[11] Patent Number: 4,810,168

[45] Date of Patent: Mar. 7, 1989

[54] LOW PULSATION PUMP DEVICE

[75] Inventors: Taro Nogami; Tsuyoshi Nishitarumizu; Kiwao Seki, all of Katsuta, Japan

[73] Assignee: Hitachi, Ltd., Tokyo, Japan

[21] Appl. No.: 111,640

[22] Filed: Oct. 22, 1987

[30] Foreign Application Priority Data

Oct. 22, 1986 [JP] Japan ..... 61-251381

[51] Int. Cl.[4] ..... F04B 49/06; F04B 3/00; F04B 49/00

[52] U.S. Cl. ..... 417/2; 417/265; 210/101

[58] Field of Search ..... 417/2, 265, 18; 210/101

[56] References Cited

U.S. PATENT DOCUMENTS 4,352,636 10/1982 Patterson ..... 417/265
4,448,692 5/1984 Nakamoto ..... 417/18
4,552,513 11/1985 Miller ..... 417/265
4,595,495 6/1986 Yotam ..... 417/18
4,600,365 7/1986 Riggenmann ..... 417/265
4,681,513 7/1987 Saito ..... 417/265

*Primary Examiner*—William L. Freeh
*Attorney, Agent, or Firm*—Antonelli, Terry & Wands

[57] ABSTRACT

A low pulsation pump device has a pulse motor, two plungers adapted to be driven by the pulse motor, a pressure sensor disposed on the output side of the plungers, a storage for storing values of pressures detected by the pressure sensor during each of a number of periods, a high speed region during which the rotational speed of the pulse motor is increased. The pulse control has an optimization function which determines, on the basis of pressure information which was obtained during the last period, the location of a high speed region in each period in such a manner as to reduce pulsations.

15 Claims, 7 Drawing Sheets

LOW PULSATION PUMP DEVICE

BACKGROUND OF THE INVENTION

The present invention relates to a low pulsation pump device, and more particularly to a low pulsation pump device which is capable of delivering liquid with low pulsations and is thus suitable for use in liquid chromatography, ion chromatography, or GPC (Gel Permeation Chromatography).

An example of a conventional low pulsation pump is a computer-controlled dual pump in which a pulse motor is provided for each of two plungers so that the two plungers essentially operate as two independent pumps. The control performed to reduce pulsations in the liquid delivered by this pump is merely an adjustment of the phase difference between the two pumps, and is not essentially different from control in which the phase difference is mechanically adjusted so as to be fixed. More specifically, if, for instance, the phase is adjusted in such a way that a pulsation is minimal in a portion of the period in which the end point of the discharge of one of the pumps overlaps the start point of the discharge of the other pump, no adjustment is provided with respect to a pulsation in a period portion in which the start point of the discharge of the first-mentioned pump overlaps the end point of the discharge of the other pump. As a result, the reduction in pulsations is imperfect if the pumps are not operating under exactly the same mechanical conditions.

Japanese Patent Laid-Open Publication No. 128678/1980 and Japanese Patent Laid-Open Publication No. 98572/1981 disclose conventional plunger pump devices The former proposal discloses a structure in which a single cam drives two pumps. Since the discharge pressure of the pumps is detected in a real-time manner to determine the start point and end point of each of high speed driving regions of the pumps, ripples cannot be completely removed because of the time lag in the feedback loop. The latter proposal discloses two plunger pumps driven by a single cam in such a way that a predetermined discharge amount is obtained by combining the liquid flows from the two pumps. The latter proposal also teaches estimation, on the basis of data on the detected rotational position of the cam, a period of time which is required until the predetermined flow rate recovers, and to change the rotational speed of a pulse motor during the particular period which has thus been estimated.

Since each of these conventional plunger pump devices includes two pumps incorporated as one unit, it has a complicated structure. In addition, since the optimization control of the pump device is nothing more than a phase adjustment between two pumps, the resulting reduction in pulsations will often be insufficient.

U.S. Pat. No. 3,855,129 discloses another pump device. However, since this pump device is adapted to control pressure fluctuations by detecting the discharge pressure of the pump in a real-time manner, pulsations can be reduced only imperfectly because of the inevitable time lag.

SUMMARY OF THE INVENTION

An object of the present invention is to provide a low pulsation pump device which is capable of reducing pulsations gradually and to a pulsation level which is completely negligible a few minutes after the actual start of use of the pump.

In order to achieve this object, the present invention provides a low pulsation pump device comprising: at least one plunger adapted to be driven by a single pulse motor; a pressure detector disposed on the output side of the plunger; memory means for storing values of pressures detected by the pressure detector during each of a number of periods; and pulse control means for creating, in each period, a high speed region during which the rotational speed of the pulse motor is increased, the pulse control means having an optimization function which determines, on the basis of pressure information which was obtained during the last period, the location of a high speed region in each period in such a manner as to reduce pulsations.

In accordance with one aspect of the present invention, the pulse motor drives a rotary shaft of twin cams in accordance with the number of control pulses, the twin cams drive two plungers in accordance with a required phase relationship, the memory means stores pressure information at a required time point or points in each period, the pulse control means operates to drive the pulse motor at a high speed during a region in each period during which the discharge pressure tends to drop (i.e., the liquid compression region in each period), and a high-speed rotation region is determined on the basis of pressure fluctuation during the previous period.

DESCRIPTION OF THE PREFERRED EMBODIMENT

Figure 1:
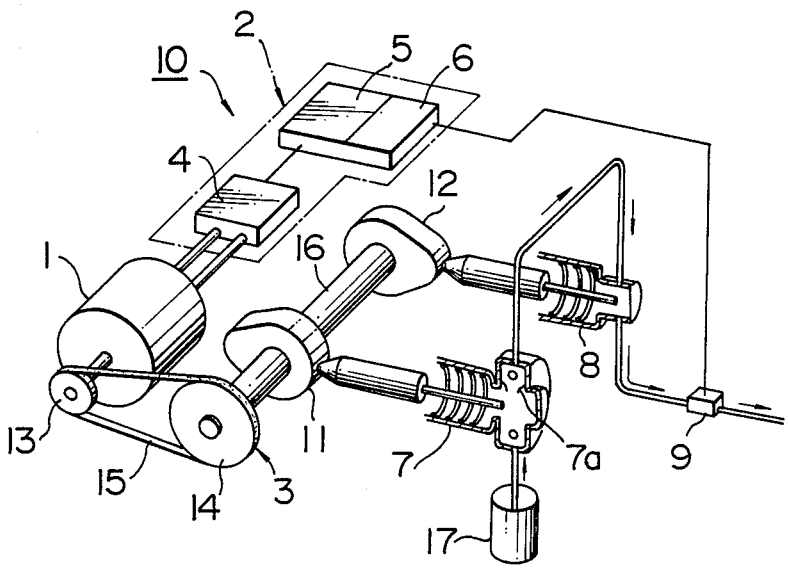
FIG. 1 is a schematic view of a low pulsation pump device in accordance with an embodiment of the present invention.

Referring to FIG. 1, there is illustrated a low pulsation pump device in accordance with an embodiment of the present invention. The pump device 10 includes a pulse motor 1, a control section 2, a power transmitting section 3, two plungers 7 and 8, a pressure sensor 9, and a liquid bottle 17. The control section 2 includes a drive circuit 4, a pulse control 5, and a storage 6. The power transmitting section 3 includes a pulley 13 secured to the output shaft of the pulse motor 1, a pulley 14 secured to a cam shaft 16, a timing belt 15 disposed around the pulleys 13 and 14, and cams 11 and 12 which are fixed to the cam shaft 16 in such a manner as to assume a predetermined phase relationship. The liquid bottle 17 is disposed on the input side of the plungers 7 and 8, while the pressure sensor 9 is disposed on the output side. As shown in FIG. 1, the two plungers 7 and 8 are connected in series. The plunger 7 which is disposed at an upstream location is provided with a check valve 7*a* and has a capacity larger than that of the other plunger 8 located downstream. Although two plungers are employed in this embodiment, a single plunger may alternatively be used. However, ripples will be larger in the case where a single plunger is used than in the case where two plungers are used.

During the operation of the pump device, the pulse motor 1 drives the cam shaft 16 through the pulleys 13 and 14 and the timing belt 15, so that the cams 11 and 12 rotate while keeping a predetermined phase relationship. Consequently, the plungers 7 and 8 repeat suction and discharge actions while keeping a predetermined phase relationship. The flow rate obtained by synthesizing the suction and discharge flow rates of the plungers represents the ultimate flow rate of the pump device.

The pressure sensor 9 sends pressure information to the storage 6, and the storage 6 stores the pressure information until the next period. The pulse control 5 corrects drive pulses on the basis of the pressure information obtained during the last period. For instance, the pulse control operates to drive the pulse motor 1 at a doubled speed in the vicinity of the liquid compression region of each period in which the discharge pressure tends to drop, and correct, on the basis of the pressure information obtained during the previous period, the timing at which the double-speed driving starts (hereinafter referred to as a "starting point") and the timing at which the double-speed driving ends (hereinafter referred to as a "end point") in each period. The correction is performed in such a way that, if it is judged that the pressure resulting from the last correction is inadequate at the beginning of the pressure drop, the starting point of the double-speed driving is advanced, while, if it is judged that the pressure resulting from the last correction is excessive at the beginning of the pressure drop, the starting point of the double-speed driving is delayed. On the other hand, if it is judged that the corrected pressure is inadequate at the end of the pressure drop, the end point of the double-speed driving is delayed, while, if it is judged that the corrected pressure is excessive at the end of the pressure drop, the end point of the double-speed driving is advanced.

Figure 2:
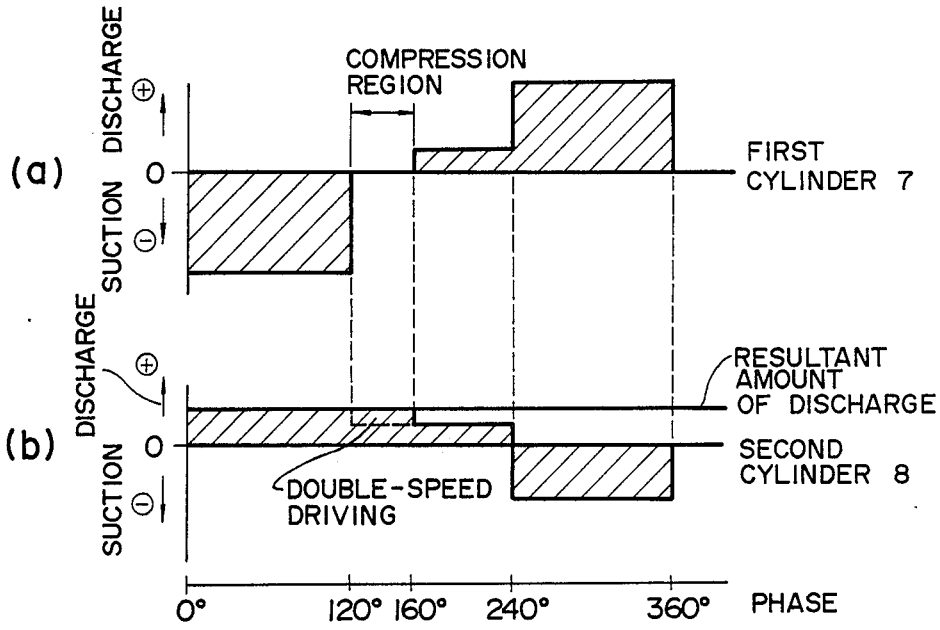
FIG. 2 is a view used to explain the operation of two plungers of the pump device shown in FIG. 1.

FIG. 2 is a view used to explain the operation of the plungers 7 and 8. Explanations will be given with reference to FIG. 2 concerning the principle of controlling the plungers 7 and 8 through the pulse motor 1 as well as the portion of the period during which pulsation tends to occur.

FIG. 2 (*a*) shows the operating condition of the first cylinder 7 while FIG. 2 (*b*) shows that of the second cylinder 8. Within the range in which the phase is 0° to 120° C., the first cylinder 7 is suctioning while the second cylinder 8 is discharging, and a flow rate obtained by synthesizing the suction and discharge rates of these cylinders represents the resultant flow rate of the pump. Within the range in which the phase is 240° to 360°, the operating conditions are close to the reverse to what is described above, and a resultant flow rate which is equivalent to what is described above is obtained. The operating condition of the pump device is complicated within the intermediate range in which the phase is 120° to 240°. In particular, within the range in which the phase is about 120° to 160°, the liquid is in the state of being compressed, and the delivery of liquid tends to be suspended. To compensate for this suspension, the cam shaft 16 is rotated at a doubled speed when the phase has passed 120° and is in the vicinity of 120°. However, the starting point and the duration of the double-speed driving are determined in dependence on the characteristics of the pump as well as the pressure resistance of a flow passage connected to the output side. Therefore, the determination is carried out by adopting optimization control in which the double-speed driving conditions of the past and the pulsation condition are stored to determine double-speed driving conditions successively.

Figure 3A:
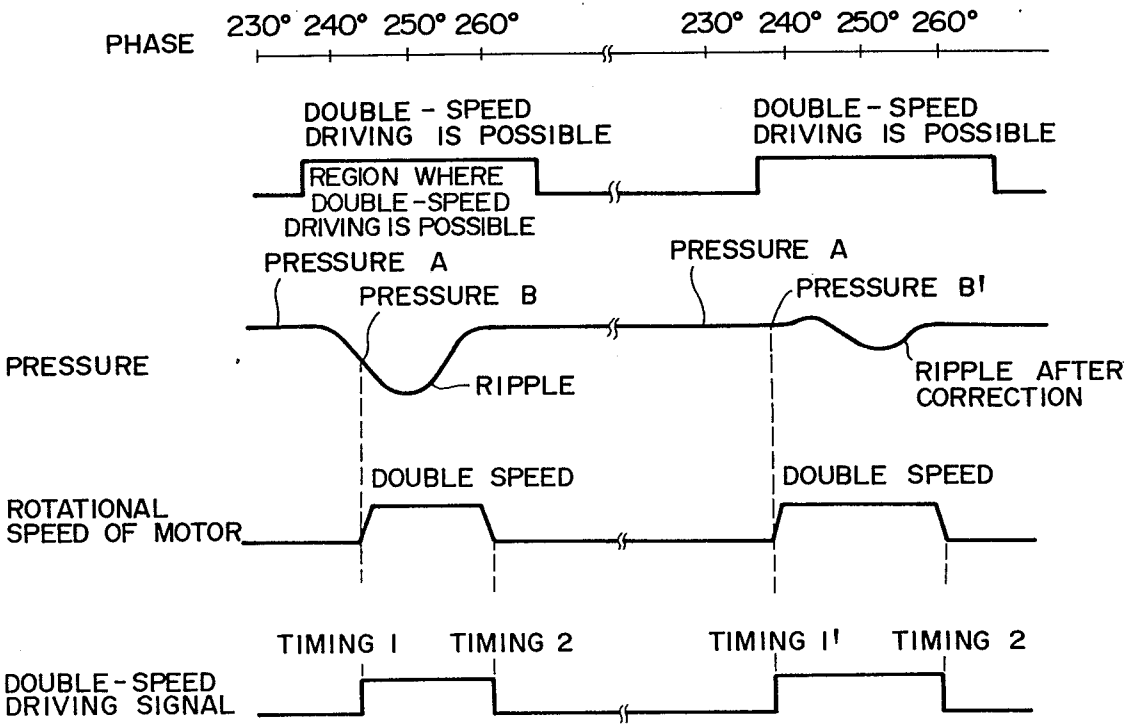
FIGS. 3*a* to 3*c* are time charts showing optimization control performed in the pump device shown in FIG. 1.
Figure 3B:
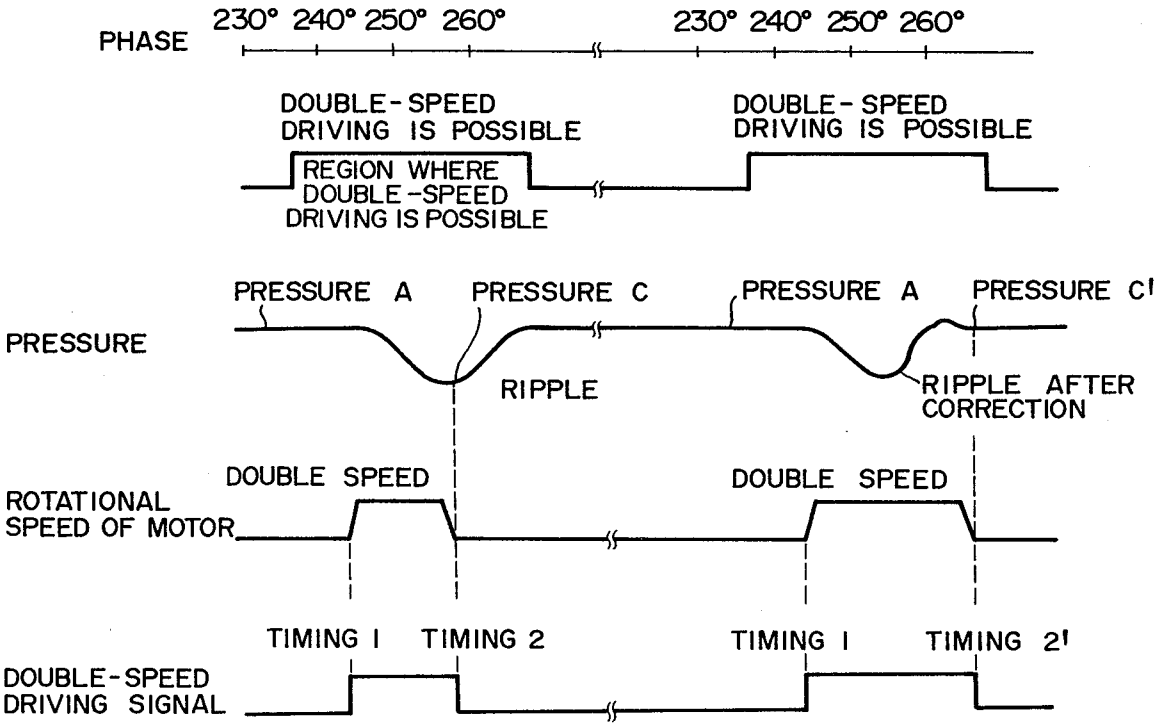
Figure 3C:
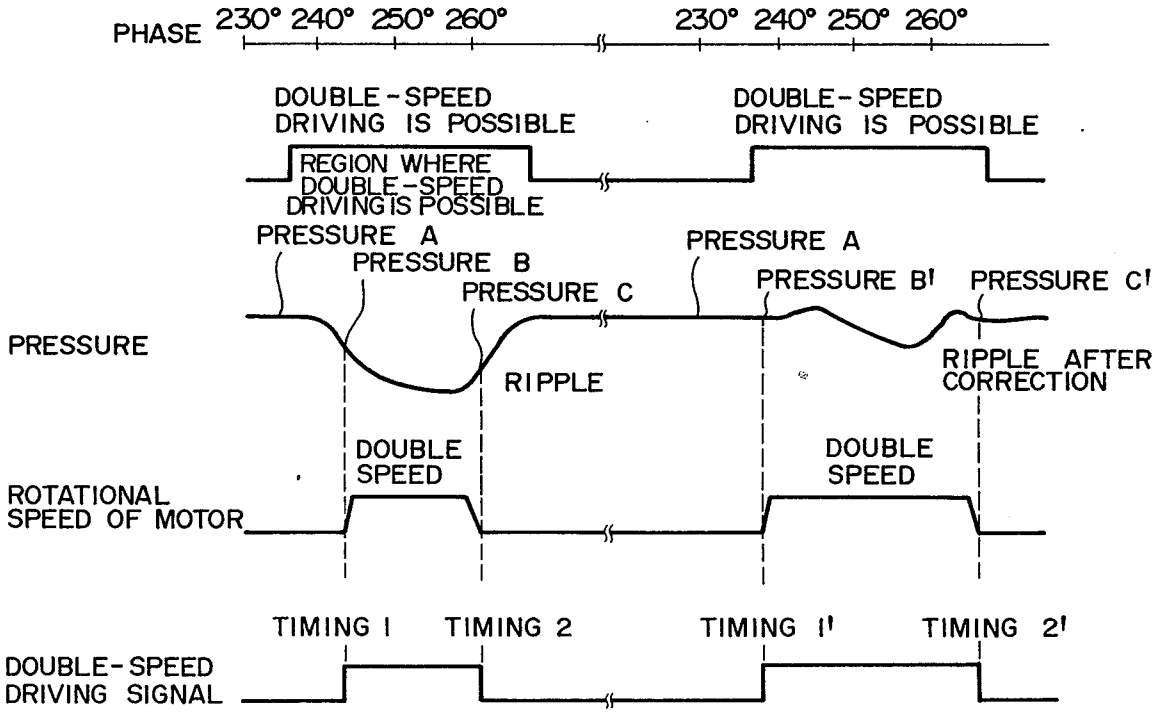

FIGS. 3*a* to 3*c* are time charts used to explain the optimization control performed in the embodiment shown in FIG. 1. FIG. 3*a* is a time chart illustrating a manner of the optimization control, in which a discharge pressure at a point at which the discharge pressure is stable in one period is compared with a discharge pressure at the starting point of the high speed region, and in which the location of the starting point of the high speed region in the next period is determined on the basis of the relationship of magnitudes of the above-mentioned discharge pressures in such a manner as to reduce pulsations. A pressure A at a pressure-stable portion in one period and a pressure B at a timing at which the rotational speed of the motor was doubled are measured and stored. The timing at which the double-speed driving will start in the next period, that is the timing 1', is determined in the following manner with respect to the timing at which the double-speed driving was started in the last period, that is to the timing 1.

($a_1$) If the relationship of pressure A>pressure B stands, the timing 1' is advanced by a predetermined difference from the timing 1.

($a_2$) If the relationship of pressure B>pressure A stands, the timing 1' is delayed by a predetermined difference from the timing 1.

($a_3$) If the relationship of pressure A≈pressure B stands, the timing 1' is determined to be the same as the timing 1.

FIG. 3*a* illustrates the case ($a_1$).

FIG. 3*b* is a time chart mainly illustrating a manner of the optimization control, in which a discharge pressure at a point at which the discharge pressure is stable in one period is compared with a discharge pressure at the end point of the high speed region, and in which the location of the end point of the high speed region in the next period is determined on the basis of the relationship of magnitudes of the above-mentioned discharge pressures in such a manner as to reduce pulsations. A pressure A at a pressure-stable portion in one period and a pressure C at a timing at which the doubling of the rotational speed of the motor was terminated are measured and stored. The timing at which a double-speed driving will end in the next period, that is the timing 2', is determined in the following manner with respect to the timing at which the double-speed driving was terminated in the last period, that is, to the timing 2.

($b_1$) If the relationship of pressure A>pressure C stands, the timing 2' is delayed by a predetermined difference from the timing 2.

($b_2$) If the relationship of pressure C>pressure A stands, the timing 2' is advanced by a predetermined difference from the timing 2.

($bv_3$) If the relationship of pressure A≈pressure C stands, the timing 2' is determined to be the same as the timing 2.

FIG. 3*b* illustrates the case ($b_1$).

FIG. 3*c* mainly illustrates a manner of the optimization control in which the locations of the starting point and end point of a high speed region are determined. Both the timings 1' and 2' are determined on the basis of the values of pressures B and C respectively at the starting point and end point of the double speed driving in the last period. FIG. 3*c* illustrates a case which is a combination of the cases ($a_1$) and ($b_1$) illustrated in FIGS. 3*a* and 3*b*, respectively.

Figure 4A:
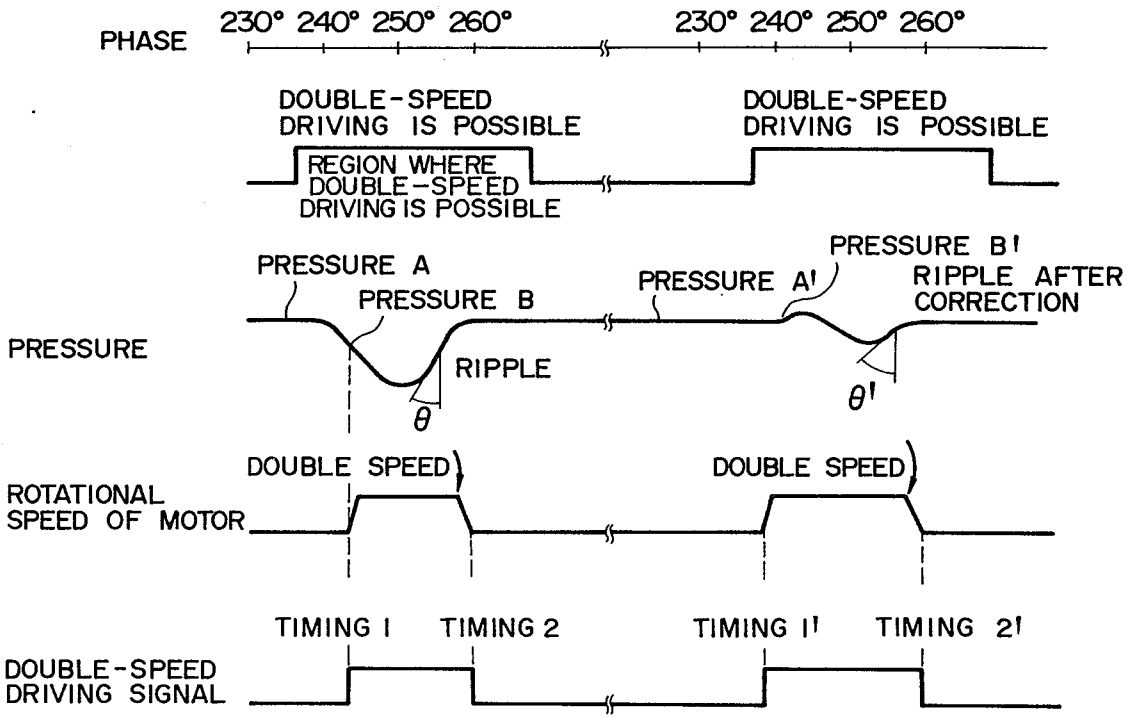
FIGS. 4*a* and 4*b* are time charts showing the manner in which the starting point of a high speed region is determined by optimization control while the end point of the high speed region is determined by realtime control, in the pump device shown in FIG. 1.

FIG. 4*a* illustrates a manner of the optimization control in which the starting point of a high speed region is determined on the basis of pressure information obtained during the last period, and in which the end point of the high speed region is determined on the basis of pressure information input in a real-time manner during the high speed region in the current period. This control is the same as the control shown in FIG. 3*a* in that the starting point of each double-speed driving is determined on the basis of the values of a pressure at the starting point of the double-speed driving in the previous period and a pressure A at a pressure-stable portion. In this control, however, the end point of each double-speed driving, that is the timing 2 or 2', is always determined by measuring, in a real-time manner, the inclination with which the pressure ripple returns to the original level, that is the angle $\theta$ or $\theta'$ shown in FIG. 4*a*, and terminating the double-speed driving at a timing at which the inclination becomes a predetermined value. This predetermined value is determined in accordance with the magnitude of the pressure A at the pressure-stable portion in one period. More specifically, the predetermined value is set at a large value when the pressure A is large and, hence, the pressure ripple is large. On the other hand, the predetermined value is set at a small value when the pressure A is small and, hence, the pressure ripple is small. The realtime control is adopted only with respect to the determination of the end point of the double speed driving because, in general, the pressure recovery which takes place in the vicinity of the ending point of a compression region is more gradual than the pressure drop which takes place in the starting point of the compression region.

Figure 4B:
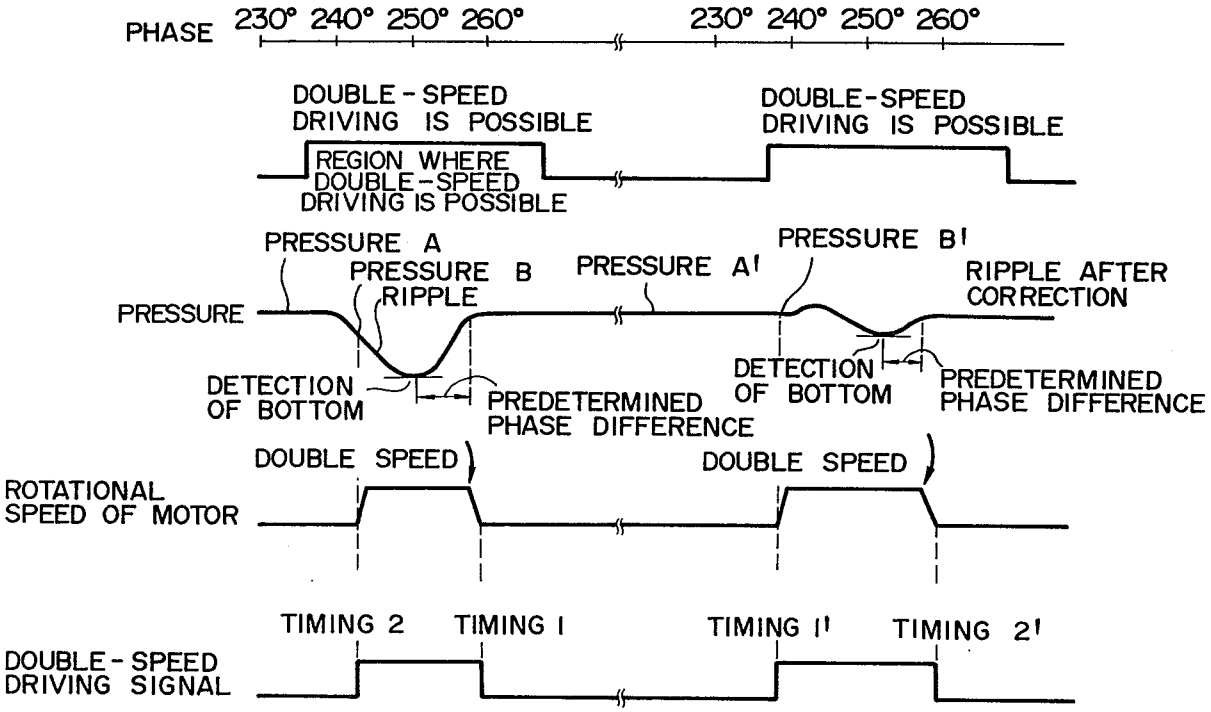

FIG. 4*b* is a time chart illustrating a manner of the optimization control in which, in the same way as the control shown in FIG. 4*b*, the starting point of a high speed region is determined on the basis of pressure information obtained during the last period, and the end point of each high speed region is on the basis of pressure information input in a real-time manner during the high speed region in the current period. This control is, however, different from the control shown in FIG. 4*a* in that the end point of each high speed region is determined by detecting the vertex at the bottom of the pressure ripple in the current period, and determining the end point as a time point which is a predetermined phase difference past the detected vertex. Since the real-time detection of the vertex at the bottom of a pressure ripple is easier than the real-time detection of the inclination of a pressure ripple, the adoption of the former detection can simplify the detecting system.

Figure 5:
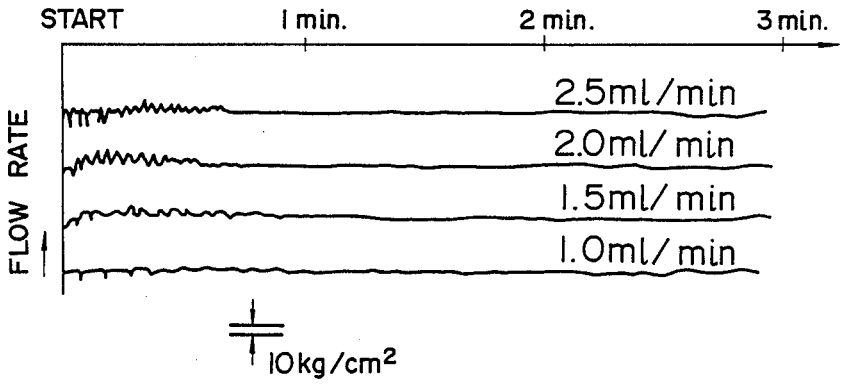
FIG. 5 is a graph illustrating the effect of reducing pulsation which is provided by the pump device in accordance with the present invention.

FIG. 5 is a graph illustrating the effect of the embodiment of the present invention. The data illustrated in FIG. 5 shows the results of reducing pulsations in accordance with the embodiment. The liquid has pulsations at the beginning of the use of the pump device and this is similar to a conventional pump device. However, pulsations are gradually reduced by repeatingly correcting the conditions for the double-speed driving through the optimization control, and they become extremely low after at least 1 minute has passed.

As described above, with the pump device in accordance with the present invention, pulsations can be reduced gradually and they can be reduced to a completely negligible level a few minutes after the actual use of the pump device. This feature of the present invention enables the obtaining of liquid chromatography data of higher accuracy than conventional data. In particular, this effect can be advantageously exhibited when performing chromatography which tends to be influenced by pulsations, such as ion chromatography (which uses a conductivity detecting device) or GPC (which uses an RI detecting device).

What is claimed is:

1. A low pulsation pump device comprising: a pulse motor; at least one plunger adapted to be driven by said pulse motor; a pressure detector disposed on the output side of said plunger; memory means for storing values of pressures detected by said pressure detector during each of a number of periods; and pulse control means for creating, in each period, a high speed region during which the rotational speed of said pulse motor is increased, said pulse control means having an optimization function which determines, on the basis of pressure information which was obtained during the last period, the location of a high speed region in each period in such a manner as to reduce pulsations.

2. A low pulsation pump device according to claim 1, wherein said pressure information comprises a discharge pressure at a time point at which the discharge pressure is stable in one period and a discharge pressure at the starting point of the high speed region, said optimization function comprising comparing said pressures and determining the location of the starting point of the high speed region in the next period on the basis of the relationship of magnitudes of said pressures in such a manner as to reduce pulsations.

3. A low pulsation pump device according to claim 1, wherein said optimization function comprises comparing a discharge pressure at a time point at which the discharge pressure is stable in one period with a discharge pressure at the end point of the high speed region, and determining the location of the end point of the high speed region in the next period on the basis of the relationship of magnitudes of said pressures in such a manner as to reduce pulsations.

4. A low pulsation pump device according to claim 1, wherein said optimization function comprises comparing a discharge pressure at a time point at which the discharge pressure is stable in one period with discharge pressures at the starting and end points of the high speed period, and determining the location of the starting and end points of the high speed region in the next period on the basis of the relationship of magnitudes of said pressures in such a manner as to reduce pulsations.

5. A low pulsation pump device according to claim 1, wherein said optimization function comprises determining the starting point of a high speed region on the basis of pressure information obtained during the high speed region in the last period, the end point of the new high speed region being determined on the basis of pressure information input in a real-time manner during the high speed region in the current period.

6. A low pulsation pump device according to claim 5, wherein said pressure information input during the high speed region in the current period is the inclination with which the pressure ripple returns to normal.

7. A low pulsation pump device according to claim 5, wherein said pressure information input during the high speed region in the current period is the bottom of the pressure ripple.

8. A low pulsation pump device according to any of claims 1 to 7, comprising two plungers connected in series in a flow passage.

9. A low pulsation pump device comprising: a pulse motor; at least one plunger adapted to be driven by said pulse motor; a pressure detector disposed on the output side of said plunger; memory means for storing values of pressures detected by said pressure detector during each of a number of periods; and pulse control means for creating, in each period, a high speed region during which the rotational speed of said pulse motor is increased, said pulse control means having an optimization function which determines, on the basis of pressure information which was obtained during the last period, the location of starting and/or end points of a high speed region in each period in such a manner as to reduce pulsations.

10. A low pulsation pump device according to claim 9, wherein said pressure information comprises a discharge pressure at a time point at which the discharge pressure is stable in one period and a discharge pressure at the starting point of the high speed region, said optimization function comprising comparing said pressures and determining the location of the starting point of the high speed region in the next period on the basis of the relationship of magnitudes of said pressures in such a manner as to reduce pulsations.

11. A low pulsation pump device according to claim 9, wherein said optimization function comprises comparing a discharge pressure at a time point at which the discharge pressure is stable in one period with a discharge pressure at the end point of the high speed region, and determining the location of the end point of the high speed region in the next period on the basis of the relationship of magnitudes of said pressure in such a manner as to reduce pulsations.

12. A low pulsation pump device according to claim 9, wherein said optimization function comprises comparing a discharge pressure at a time point at which the discharge pressure is stable in one period with discharge pressures at the starting and end points of the high speed period, and determining the location of the starting and end points of the high speed region in the next period on the basis of the relationship of magnitudes of said pressures in such a manner as to reduce pulsations.

13. A low pulsation pump device according to claim 9, wherein said optimization function comprises determining the starting point of a high speed region on the basis of pressure information obtained during the high speed region in the last period, the end point of the new high speed region being determined on the basis of pressure information input in a real-time manner during the high speed region in the current period.

14. A low pulsation pump device according to claim 13, wherein said pressure information input during the high speed region in the current period is the inclination with which the pressure ripple returns to normal.

15. A low pulsation pump device according to claim 13, wherein said pressure information input during the high speed region in the current period is the bottom of the pressure ripple.

* * * * *